United States Patent [19]

deMey, III

[11] Patent Number: 4,582,364

[45] Date of Patent: Apr. 15, 1986

[54] SHEAR LOCK KEEPER RING

[75] Inventor: Charles F. deMey, III, Bristol, Va.

[73] Assignee: Hughes Tool Company, Houston, Tex.

[21] Appl. No.: 606,035

[22] Filed: May 1, 1984

[51] Int. Cl.[4] ..... E21B 10/00

[52] U.S. Cl. ..... 299/92; 299/79; 299/91; 299/93

[58] Field of Search ..... 299/92, 86; 279/94, 279/95, 89, 105, 19.7; 403/326, 2; 339/59, 217.5; 24/297

[56] References Cited

U.S. PATENT DOCUMENTS

| | | | |
|---|---|---|---|
| 3,079,582 | 2/1963 | Lazar | 339/217.5 |
| 3,752,515 | 8/1973 | Oaks et al. | 299/86 X |
| 4,247,147 | 1/1981 | Rettkowski | 299/92 X |
| 4,327,947 | 5/1982 | Bower, Jr. | 279/19.7 X |
| 4,363,160 | 12/1982 | Wibrow | 24/297 |
| 4,484,783 | 11/1984 | Emmerich | 299/86 |

*Primary Examiner*—Stephen J. Novosad
*Assistant Examiner*—Thomas J. Odar
*Attorney, Agent, or Firm*—Robert A. Felsman; Charles D. Gunter, Jr.

[57] ABSTRACT

A shear lock keeper ring is shown for maintaining the shank of a bit in contact with the retaining shoulder in the shank receiving opening of a bit mounting block of the type found on earth working machinery. The keeper ring is formed from a resilient material and has a ring-shaped inner portion which is received about the bit shank within a retaining groove on the shank. The keeper has a resilient outer portion which overlays the inner portion and which is joined to the inner portion at a shearable junction. The outer portion is deformable inwardly toward the inner portion during assembly of the shaft into the block opening. The outer portion is shearable upon opposite relative movement of the shaft in the block opening to disassemble the shaft from the block.

6 Claims, 8 Drawing Figures

FIG. 1
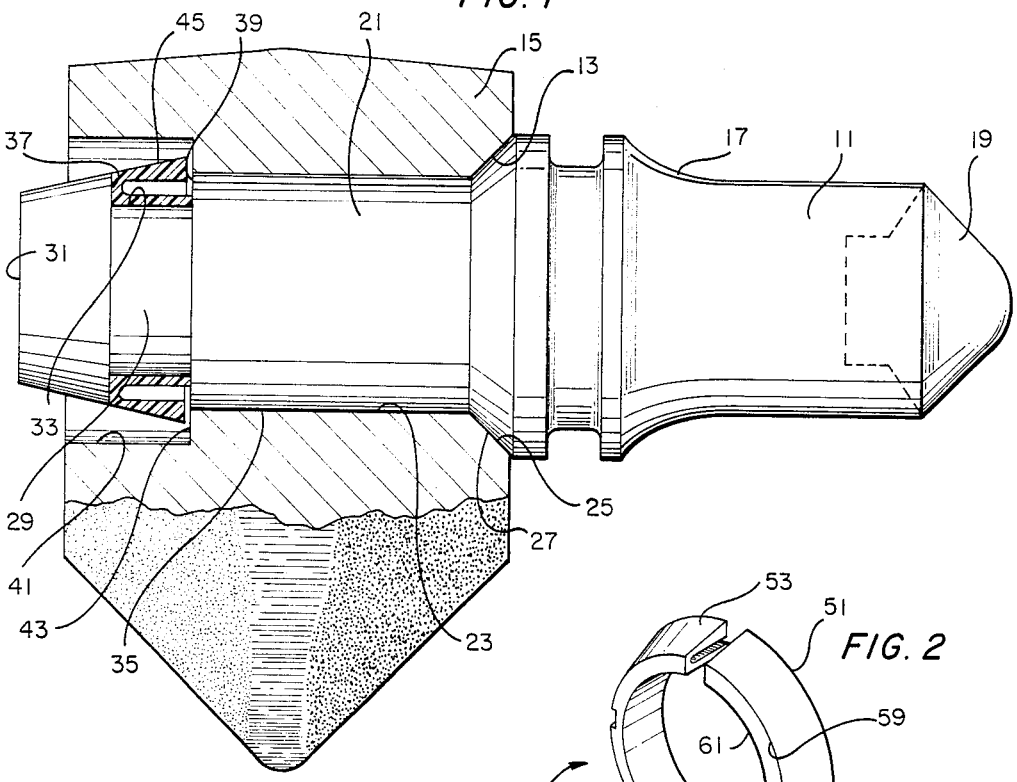
FIG. 2
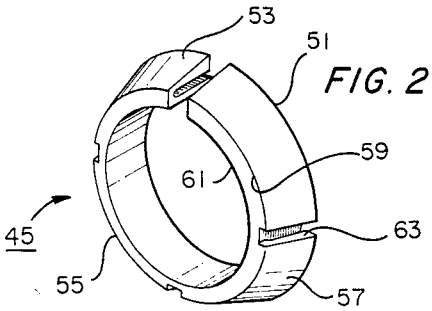
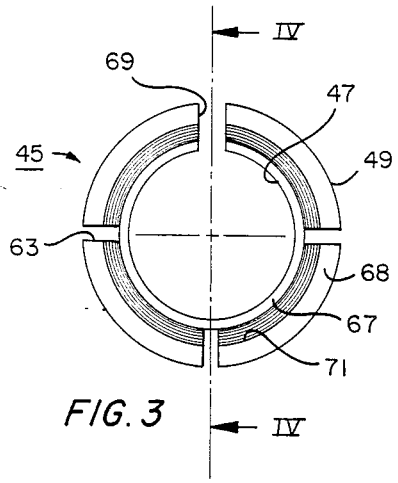
FIG. 3
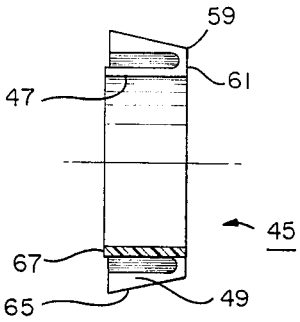
FIG. 4

SHEAR LOCK KEEPER RING

BACKGROUND OF THE INVENTION

1. Field of the Invention

The present invention relates to means for mounting work tools, such as cutter bits, in the holders of machinery used in mining, excavating and earth working for presenting the bits in proper working position so that they can be driven against the face of the material to be worked.

2. Description of the Prior Art

U.S. Pat. No. 3,342,531, issued Sept. 19, 1967, to Krekeler, shows cutter bits held within mounting blocks by resilient retainers whereby the cutting bit is rotatable within the mounting block. The retaining means include spring wires, lug members, and the like.

U.S. Pat. No. 3,519,309, issued July 7, 1970, to Engle et al shows cutting bits which are retained within a mounting block by metal, split-rings having a pluralilty of dimple-like projections thereon. The metal ring is itself captive on the bit shank but freely rotatable thereon.

U.S. Pat. No. 4,201,421, issued May 6, 1980, to Den Besten et al shows a cutter bit mounted within a mounting block by a split, spring sleeve which is non-rotatable within the mounting block.

The above described keeper mechanisms primarily involve the use of a metal sleeve, ring, or the like, which is carried in a retaining groove on the bit shank and which snap into a region of enlarged diameter within the mounting block to retain the bit shank in the block. The retaining means are carried loosely on the bit shank to allow the bit shank some degree of rotation within the mounting block during cutting operation. The shank holding capabilities of the above described retainers are sometimes adversely affected because the shank becomes worn during use and is more loosely accommodated within the mounting block opening. With other of the prior designs, the retaining mechanism works adequately but cannot be easily removed when the time comes to replace the cutting element in the mounting block.

U.S. Pat. No. 3,767,266, issued Oct. 23, 1973, to Krekeler shows a resilient keeper ring made from plastic which is used to retain a cutter within a mounting block. The resilient ring is generally cylindrical and has a pair of end rims joined by parallel ribs having a series of angularly disposed, outwardly protruding rib-like portions. The parallel ribs form a web-like structure which flattens out during installation of the bit shank within the mounting block but snaps back to form an abutment surface which is retained against a shoulder in the moutning block to hold the cutter in position during the cutting operation. To remove the cutter, the shank is driven in the opposite direction. At this time, the webs are intended to again flatten out so that the bit shank can be removed form the mounting block opening. This design has proved problematical in that the dirt and other debris lodges between the shank exterior and internal diameter of the mounting block opening which keeps the resilient webs from collapsing and makes the shank difficult to remove.

SUMMARY OF THE INVENTION

The shear lock keeper ring of the invention is used to maintain the shank of a bit in contact with a retaining shoulder in the shank receiving opening of a bit mounting block of the type found on earth working machinery. The keeper ring comprises a resilient keeper having a ring-shaped inner portion which is adapted to be snugly received about the bit shank within a retaining groove on the shank exterior. The resilient keeper has a resilient outer portion which generally circumscribes the inner portion. The outer portion is joined to the inner portion at a bendable junction. Preferably, the inner and outer portions are formed from plastic material and the juncture comprises an elastic hinge whereby the outer portion is deformable inwardly toward the inner portion during assembly of the shaft into the block opening. The outer portion is preferably shearable along the elastic hinge to release the shaft upon opposite relative movement of the shaft in the opening to disassemble the shaft from the block.

Additional objects, features and advantages will be apparent in the written description which follows.

BRIEF DESCRIPTION OF THE DRAWINGS

FIG. 1 is a side view of the keeper ring of the invention shown in place on a cutter bit within a mounting block with the keeper ring and mounting block shown in cross-section.

FIG. 2 is a front perspective view of the keeper ring of the invention.

FIG. 3 is a rear perspective view of the keeper ring of FIG. 2.

FIG. 4 is a side, perspective view of the keeper ring taken along lines IV—IV in FIG. 3.

DETAILED DESCRIPTION OF THE INVENTION

Figure 5:
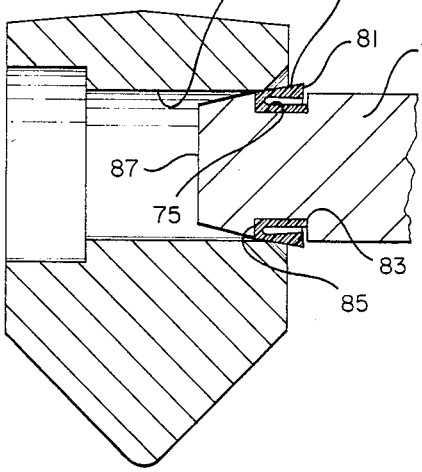
FIG. 5 is a side, cross-sectional view of the assembly of the keeper ring of the invention into the mounting block showing the beginning stage of the assembly.

FIG. 1 shows a work tool of the type toward which the present invention is directed. The work tool includes a cutter bit 11 which is received within the shank receiving opening 13 of a mounting block 15. The cutter bit 11 has a head portion 17 which includes a cutting end 19 and has a generally cylindrical shank 21 which is slidably received within the bore 23 of the mounting block 15. The mounting block bore 23 includes a tapered mount region 25 which includes a groove 29 adjacent the end 31 opposite the cutting end 19. The groove 29, as shown in FIG. 1, is comprised of a cylindrical surface 33 of lesser relative diameter than the external surface 35 of the shank 21 and is bounded by end walls 37, 39.

The mounting block bore 23, as shown in FIG. 1, is stepped and forms a region of increased diameter 41 adjacent shank end 31, thereby forming a retaining shoulder 43. It should be understood that the region 41 could be less than completely cylindrical and could be, for instance, partly cut away in some mounting block structures. Various mounting block structures are known in the art which include a shaft receiving opening or bore 23 and which present a retaining shoulder 43.

As shown in FIG. 1, the shear lock keeper ring 45 of the invention is received within the groove 29 of the bit shank 21. The keeper ring 45 is shown in greater detail in FIGS. 2–4. The keeper ring 45 is comprised of a ring-shaped inner circumferential portion 47 which is of a size selected to be closely received about the diameter of the groove 29 on the shank exterior. By appropriately sizing the diameter of the keeper ring 45, the inner portion 47 can be snugly received about the cylindrical surface 33 of groove 29 whereby the keeper ring 45 will attempt to form a seal with the groove to prevent the passage of dirt. The keeper ring 45 also has a resilient outer portion 49 which is made up of a plurality of segments 51, 53, 55, and 57 (FIG. 2) which are joined at a leading edge 59 thereof to a leading edge 61 of the inner portion 47. Each segment 51 is separated from an adjacent segments 57 by a transverse slot 63. The width of slots 63 can be increased to provide segments 51, 53, 55 and 57 of lesser width where it appears desirable to facilitate the passage of dirt and cuttings about the keeper ring assembly.

In the embodiment shown, the keeper ring 45 is formed from a resilient synthetic material, such as plastic and the leading edges 59, 61 form a juncture in the nature of an elastic hinge whereby the outer portion 49 is deformable inwardly toward the inner portion 47 during the assembly of the shaft into the block opening 13. In the embodiment shown in FIG. 4, the outer portion 49 is of generally triangular cross-sectional area so that the outer surface 65 is oriented on a taper with respect to the inner portion 47 and flairs outwardly from a trailing edge 67 of the inner portion 47.

As shown in FIG. 3, the inner and outer portions 47, 49 are separated at one point in the circumference thereof to create a ring opening 69 in the keeper ring 45. The ring opening 69 allows the keeper 45 to be stretched apart sufficiently to allow the keeper ring 45 to be installed within the groove 29 on the shank exterior. As shown in FIGS. 3 and 4, the inner and outer portions 47, 49, when viewed from the trailing edges 67, 68 create a circumferential groove 71 which is interrupted at equidistant intervals by slots 63.

The operation of the keeper ring of the invention will now be described. Returning to FIGS. 5–8, there is shown a cutter shank 73 with a retaining groove 75 into which is positioned a keeper ring 77 of the invention. The shank 73 is inserted within the mounting block opening 79 in the direction indicated by the arrow and the diameter of the opening 79 is selected to allow the shaft 73 and resilient keeper 77 to be slidably received within the opening when the outer portion 81 is deformed inwardly toward the inner portion 83. The keeper ring 77 is oriented with the edge 85 nearest the shank end 87 opposite the cutting end.

Figure 6:
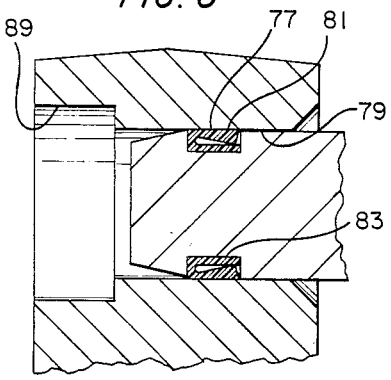
FIG. 6 is a view similar to FIG. 5 showing the intermediate stage of the assembly of the keeper ring of the invention.

As shown in FIG. 6, the resilient outer portion 81 of the keeper 77 is folded back over and compressed against the inner portion 83 of the keeper during the beginning stages of the assembly. As the shaft is inserted further into the opening 79, the groove 75 passes into the region of increased diameter 89, allowing the outer portion 81 to spring back outwardly to the configuration shown in FIG. 7. The trailing edge 91 of the keeper ring 77 then forms an abutment surface which contacts the retaining shoulder 93 of the mounting block 95 to retain the shank in the position shown.

Figure 7:
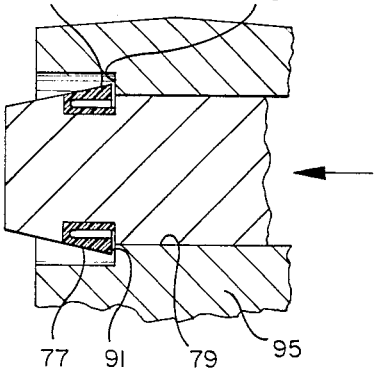
FIG. 7 is a view similar to FIG. 6 showing the completed assembly of the keeper ring of the invention.
Figure 8:
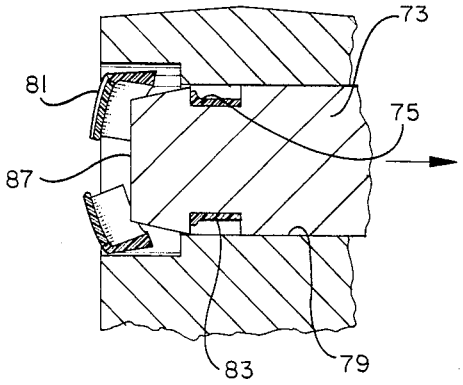
FIG. 8 is a view similar to FIG. 7 showing the disassembly of the keeper ring of the invention.

When the shank is asembled as shown in FIG. 7, some degree of shank rotation is allowed within the opening 79, but axial movement of the shank within the opening 79, in the direction of the arrow shown in FIG. 8, is restrained. Since the force imparted by the working surface upon the cutting element is in the direction shown by the arrow in FIG. 7, the keeper ring 77 is not affected. When it becomes desirable to remove the shank 73, as for changing the cutting element, force is exerted to the shank end 87 in the direction of the arrow shown in FIG. 8, causing the outer portion 81 of the keeper ring 77 to be sheared along the region of the elastic hinge. The inner portion 83 of the keeper ring is retained within the groove 75, thereby allowing the shank 73 to be slidably removed from the opening 79.

An invention has been provided with several advantages. The keeper ring of the invention can be inexpensively manufactured from a number of convenient resilient plastic materials. The keeper allows the shank to be installed within the mounting block by hand, thereby reducing assembly time. The keeper is a positive locking mechanism and does not rely upon friction for retention within the mounting block. The bit shank can be easily removed from the mounting block by striking the end opposite the cutting end with a hammer or bit wrench as opposed to the greater difficulty which is encountered in removing present bit keeper mechanisms. Since the keeper ring outer portion is shearable, there is no possibility that the keeper ring will become lodged by dirt and debris within the mounting block.

While the invention has been shown in only one of its forms, it is not thus limited but is susceptible to various changes and modifications without departing from the spirit thereof.

I claim:

1. A shear lock keeper ring for mounting the shank of a bit in contact with a retaining shoulder in the shank receiving opening of a bit mounting block of the type found on earth working machinery, comprising:

a resilient keeper having a ring-shaped inner circumferential wall portion adapted to be received closely about said bit shank within a retaining groove on said shank exterior, said inner circumferential wall portion of said keeper serving to form a seal with said retaining groove to prevent the passage of dirt between said keeper and retaining groove, said resilient keeper having resilient outer portions, which overlay said inner portion, said outer portions being joined to said inner portion at leading edges thereof, each of said junctures of said inner and outer portions comprising an elastic hinge with said outer portions oriented on a taper with respect to said inner portion whereby said outer portions flare outwardly from a trailing edge of said inner portion, said outer portions being deformable inwardly toward said inner portion during assembly of said shaft into said block opening and said outer portions being bendable along said elastic hinge to release said shaft upon opposite relative movement of said shaft in said opening to disassemble said shaft form said block.

2. The keeper ring of claim 1, wherein said inner and outer portions are formed of a pliable, plastic material, whereby the traililng edges of said outer portions are capable of radial compression in the direction of said shaft exterior during assembly.

3. The keeper ring of claim 2, wherein the diameter of said block opening is selected to allow said shaft to be slidably received within said opening during assembly and disassembly and wherein the depth of said retaining groove on said shaft is of a predetermined depth sufficient to allow said keeper outer portions to be radially compressed therein to the approximate outer dimension of said shaft exterior to allow said shaft and keeper to be installed within said block during assembly.

4. The keeper ring of claim 3, wherein said outer portions of said resilient keeper extend beyond the outer dimensions of said shaft to contact said retaining shoulder when said shaft is fully assembled within said block.

5. The keeper ring of claim 5, wherein said inner and outer portions are spaced apart at one point in the circumference thereof to create a ring opening in said keeper ring.

6. The keeper ring of claim 5, wherein said outer portions of said resilient ring are spaced apart by a plurality of slots formed therein, said slots being spaced apart in equidistant fashion about the circumference thereof.

* * * * *